US010512820B2

(12) United States Patent
Strong Crawley

(10) Patent No.: US 10,512,820 B2
(45) Date of Patent: Dec. 24, 2019

(54) BALANCE EXERCISE DEVICE

(71) Applicant: Amy Caroline Strong Crawley, Draper, UT (US)

(72) Inventor: Amy Caroline Strong Crawley, Draper, UT (US)

( * ) Notice: Subject to any disclaimer, the term of this patent is extended or adjusted under 35 U.S.C. 154(b) by 319 days.

(21) Appl. No.: 15/439,832

(22) Filed: Feb. 22, 2017

(65) Prior Publication Data

US 2017/0157467 A1 Jun. 8, 2017

Related U.S. Application Data

(60) Provisional application No. 62/298,385, filed on Feb. 22, 2016.

(51) Int. Cl.
*A63B 26/00* (2006.01)
*A63B 21/00* (2006.01)
(Continued)

(52) U.S. Cl.
CPC ..... *A63B 26/003* (2013.01); *A63B 21/4035* (2015.10); *A63B 23/0458* (2013.01); *A63B 21/0442* (2013.01); *A63B 23/1236* (2013.01)

(58) Field of Classification Search
CPC ..... A63B 21/0004; A63B 21/00058; A63B 21/00061; A63B 21/00065; A63B 21/00069; A63B 21/00076; A63B 21/00178; A63B 21/00181; A63B 21/00185; A63B 21/002; A63B 21/0023; A63B 21/0085; A63B 21/02; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/068; A63B 21/072; A63B 21/4023; A63B 21/4025; A63B 21/4027; A63B 21/4029; A63B 21/4033; A63B 21/4034; A63B 21/4035; A63B 21/4043;
(Continued)

(56) References Cited

U.S. PATENT DOCUMENTS 5,499,417 A * 3/1996 Wang ..... A47C 7/021 177/144
D507,026 S * 7/2005 Chen ..... D21/671
(Continued)

*Primary Examiner* — Gary D Urbiel Goldner
(74) *Attorney, Agent, or Firm* — Alpine IP PLLC; David A. Jones

(57) ABSTRACT

A multi-purpose balance exercise device designed to be used in multiple positions and for diverse exercises. For example, various embodiments allow for the device to be used as an aerobic step device as well as the ability to easily adjust the device to various heights to easily decrease the level of difficulty of the device for use during various exercises. The balance exercise device can provide a plurality of handles and grab points both horizontally and vertically, which allow for an enhanced number of exercises or movements using either the top and/or bottom of the device. The exercise device includes a flexible bladder filled with air, other gases, or gels attached to a substantially rigid base. The base can include an interior within which features such as handles are disposed to provide a gripping or lifting exercise for which the balance exercise device can be used.

17 Claims, 11 Drawing Sheets

(51) Int. Cl.
*A63B 23/04* (2006.01)
*A63B 21/04* (2006.01)
*A63B 23/12* (2006.01)

(58) Field of Classification Search
CPC . A63B 23/02; A63B 23/0205; A63B 23/0211; A63B 23/0216; A63B 23/0222; A63B 23/035; A63B 23/03508; A63B 23/03516; A63B 23/03525; A63B 23/03533; A63B 23/03541; A63B 23/0355; A63B 23/03575; A63B 23/04; A63B 23/0405; A63B 23/0458; A63B 23/0482; A63B 23/0494; A63B 23/012; A63B 23/1209; A63B 23/1236; A63B 23/1245; A63B 23/1281; A63B 2023/0411; A63B 26/00; A63B 26/003; A63B 71/02; A63B 71/023; A63B 2071/026; A63B 2071/027; A63B 2208/0204; A63B 2208/0209; A63B 2208/0214; A63B 2208/0223; A63B 2208/0228; A63B 2208/0242; A63B 2208/0252; A63B 2208/0295; A63B 2210/00; A63B 2210/50; A63B 2225/09; A63B 2225/093; A63B 2225/62
See application file for complete search history.

(56) References Cited

U.S. PATENT DOCUMENTS

D507,311 S * 7/2005 Butler ..... D21/686
D517,136 S * 3/2006 Chen ..... D21/671
D822,774 S * 7/2018 Strong Crawley ..... D21/671
2005/0020418 A1* 1/2005 Lin ..... A63B 21/0552 482/142
2005/0049123 A1* 3/2005 Dalebout ..... A63B 21/04 482/142
2007/0087902 A1* 4/2007 Penat ..... A63B 21/068 482/52
2009/0215596 A1* 8/2009 Obermaier ..... A63B 5/08 482/142
2010/0087299 A1* 4/2010 Babiarz ..... A63B 21/00069 482/142
2011/0224059 A1* 9/2011 Crawley ..... A63B 21/078 482/142
2011/0306480 A1* 12/2011 Beaulieu ..... A63B 23/0458 482/142
2012/0015787 A2* 1/2012 Strong Crawley .. A63B 21/078 482/142
2012/0208678 A1* 8/2012 Knilans ..... A63B 23/0458 482/52
2015/0018178 A1* 1/2015 Carbone ..... A63B 71/0009 482/146
2015/0057138 A1* 2/2015 Knilans ..... A63B 26/003 482/142
2015/0190679 A1* 7/2015 Carbone ..... A63B 26/003 482/146
2016/0199689 A1* 7/2016 Irwin ..... A63B 23/0458

* cited by examiner

BALANCE EXERCISE DEVICE

CROSS-REFERENCE TO RELATED APPLICATIONS

This application claims the benefit of and priority to U.S. Provisional Patent Application 62/298,385 filed Feb. 22, 2016, the contents of which are hereby incorporated by reference herein.

BACKGROUND

Balance training devices and aerobic steppers have been around for years in different configurations. Step aerobics is where a person steps on and off a slightly elevated platform and has long been an important form of exercise. Step aerobics provides a cardiovascular workout with minimal investment of equipment such that a wide spectrum of persons can enjoy this form of exercise. Although many people own and use a step aerobic platform, current exercise equipment that consist strictly of a raised platform is inadequate for the use of multiple muscles including balance and core training.

Moreover, the shape of aerobic steppers and balance exercises have poor utilization of materials and a seriously limited scope of exercises that can be performed thereon. Not to mention, traditional balance training devices have mainly focused on the convenient use of one surface or side of the device that has been limited to a step exercise. Traditional aerobic step devices have only offered hard step surfaces that do not incorporate core training. And, current balance devices are made from a plurality of devices utilizing plastic, air springs, and other methods to create an unstable surface. One problem is the limitations which current shapes and features of such step aerobic devices provide.

The subject matter claimed herein is not limited to embodiments that solve any disadvantages or that operate only in environments such as those described above. Rather, this background is only provided to illustrate examples of the technology area where some embodiments described herein may be practiced and find certain advantages.

SUMMARY

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

A balance exercise device is disclosed including a substantially rigid base. The substantially rigid base includes a top surface, a bottom surface, a first side wall extending along a length, and a second side wall extending along a length and being disposed opposite to the first sidewall. The balance exercise device further includes two opposing curved half-circle end walls extending from the opposite substantially straight side walls and creating a capsule shaped outer periphery of the substantially rigid base. The balance exercise device further includes a flexible bladder fastened to the outer periphery of the substantially rigid base, the flexible bladder creating an unstable balance exercise surface when filled with air for use during a balance exercise.

The side walls and end walls of the base can define a base interior, the base interior including one or more exercise features. The one or more exercise features can include two handles affixed to an interior surface of the base, the two handles being centrally disposed proximate to the ends of the base and within an interior of the side walls and end walls. The handles can enable a user to perform pushup exercises with the flexible bladder placed against the ground. And the handles can be disposed within the base interior when the bottom surface of the base is placed on the ground thereby enabling the user to step or stand on the flexible bladder during exercise. The handles also enable a user to lift the balance exercise device using the weight of the balance exercise device during a lifting exercise.

The base can include opposing cutouts defined in the side walls. Opposing rods can be disposed within an interior of the base and extending along an interior length of the base side walls and adjacent to the cutouts defined in the side walls.

The base can include a plurality of resistant band attachment features disposed in the side walls or end walls of the base. The resistant band attachment features can include a plurality of cutout features in the bottom surface of the base. The attachment features can include multiple cutout features on opposing side walls and/or end walls for repositioning the location of the resistant band extending from different locations of the bottom surface of the base. The balance exercise device can be provided along with a resistance band coupled to two of a plurality of selectable cutouts in the bottom surface of the base during use and may or may not be provided together in an exercise device or set.

The balance step exercise device can be associated with a first exercise position where a first exercise is performed with the base against the ground, a second exercise position where a second exercise is performed with the bladder against the ground, and a third exercise position where a third exercise is performed lifting the balance step exercise device overhead.

The balance step exercise device can have a capsule shape. The flexible air-filled bladder can include a flat peripheral seal for mating with a periphery of the top surface of the substantially rigid base to create an air-tight seal there between. A capsule shaped compression ring can be made of a substantially rigid material and shaped so as to extend over and around a periphery of the flexible air-filled bladder to firmly hold the periphery of the flexible air-filled bladder against a periphery of the top surface of the base. A plurality of fasteners can extend through the compression ring and be configured to compress the outer periphery of the flexible air-filled bladder against the outer periphery of the substantially rigid base to create an airtight seal there between. The compression ring can create a substantially flat horizontal lip between vertical extension of side walls of the base and semi-vertical extension of flexible air-filled bladder when inflated.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION ILLUSTRATING THE INVENTION

Figure 1A:
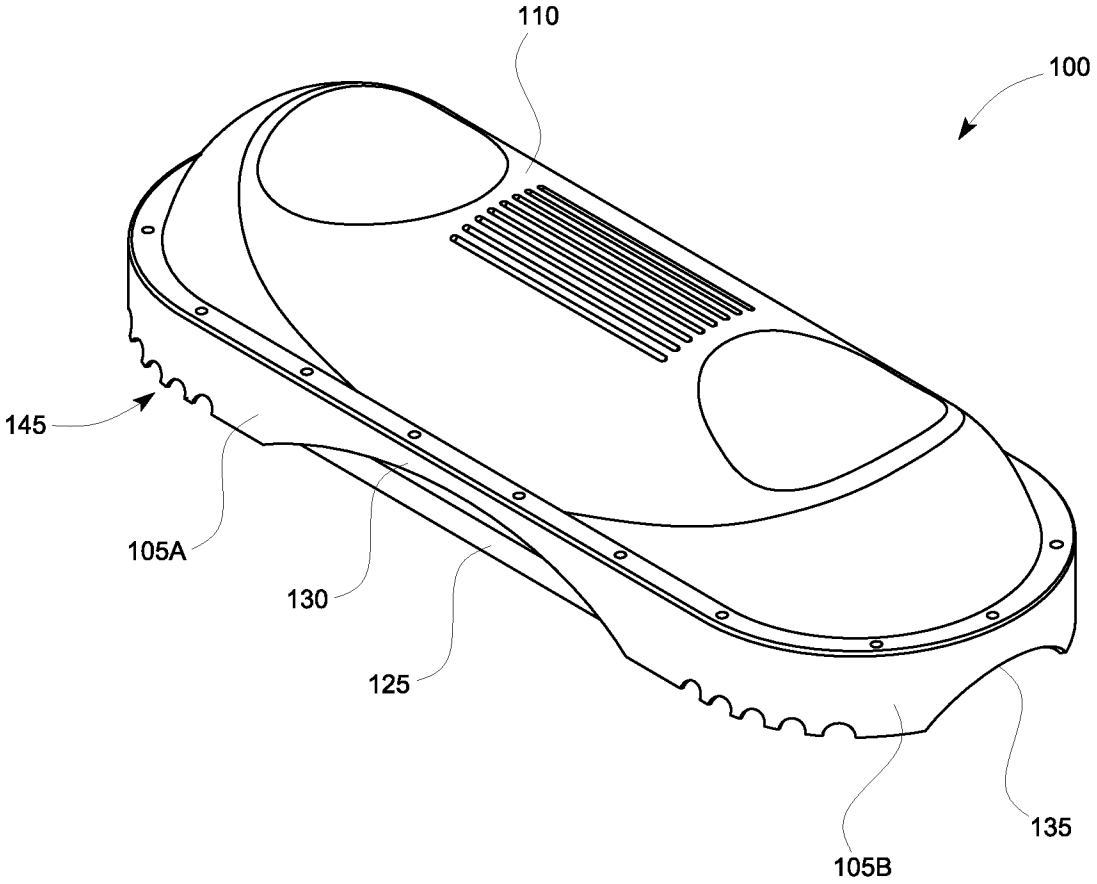
FIGS. 1A and 1B illustrate a balance exercise device.

The following embodiments illustrate various embodiments of a multi-purpose balance step exercise device. Various designs not only fit the natural shape of the body better than currently available designs, but also add a plurality of devices to the product which allow the product to be used in multiple positions and for diverse exercises. For example, various embodiments allow for the multipurpose device to be use as an aerobic step device as well as the ability to easily adjust the device to various heights to easily increase or decrease the level of difficulty of the device for use during various exercises. The ability to adjust the angle and height of the device also enables additional diverse exercises in addition to traditional step exercises.

The balance exercise device can provide a plurality of handles and grab points both horizontally and vertically, which allow for an enhanced number of exercises or movements using either the top and/or bottom of the device. The balance exercise device can have specific ports and arches to accommodate the use of accessories or resistance bands in conjunction with the device. The balance exercise device can be filled with air, other gases, or gels. The internal pressure can be selectively inflated or deflated. The increase or decrease in internal pressure can be used to change a level of difficulty associated with the exercise. And, the internal pressure can also be changed depending on the type of exercise performed using the balance exercise device.

For example, a first internal pressure can be associated with a first lower level of difficulty and a second internal pressure can be associated with a second higher level of difficulty. Similarly, a first internal pressure can be associated with a first step exercise performed using the balance exercise device and second internal pressure can be associated with a second exercise performed while lying on the balance exercise device. Similarly, a different internal pressure can be associated with using the balance exercise device to perform a push up exercise and a different internal pressure can be used while standing on the balance exercise device performing an exercise in connection with resistance bands extending around the base of the balance exercise device. Thus, any number of different exercises disclosed herein for use with the balance exercise device can have a corresponding internal pressure associated thereto. And, the internal pressure associated thereto can also be associated with a difficulty or personal user attribute such as weight or size of the person performing the exercise.

The balance exercise device can include specific ports and arches to accommodate the use of the device with various exercises or its use with various accessories or resistance bands in conjunction with the balance exercise device. The balance exercise device can include a series of ports or holes to allow for the addition of various accessories to enhance specific muscle and strength regions. The various accessories can include a bar that is coupleable to the base of the balance exercise device to allow for a pushing exercise where the device is pushed across multiple surface for ease of movement and exercise. The bar can also be configured to provide for a multitude of activities, exercises, and storage. Thus, the various accessories can be disconnected from the balance exercise device to allow for more compact storage thereof.

The balance exercise device can include recognizable indicia which allows the user to access a readable computer application or website to access different exercises, training instructions or tips for use of the balance exercise device. The recognizable indicia can include a scan able code associated with the particular device, user, and/or exercise program. The website can also suggest supplemental exercises, accessories, and training. This dash board of online features can provide the user with different exercises for different body parts associated with the balance exercise device.

The balance exercise device can be provided along with height adjustment means. The height adjustment means can include a height varying block that is added to a base of the balance exercise device to increase the overall height of the balance exercise device above ground. Similarly, different height adjustment means can be provided to variably adjust the relative height of a side or portion of the balance exercise device above ground.

The balance exercise device can include a grip pattern on both the top and bottom surface for ease and safety of use in multiple positions. The grip pattern can include ridges or textures and be disposed on the balance exercise device for each particular use of exercise associated with the balance exercise device.

The balance exercise device can include an inflation valve that can be disposed on a side of the balance exercise device. The valve can be used to inflate the bladder which can form an airtight sealed and pressurized instability bladder for use during multiple different exercises. The air, gas, or gel filled bladder can include antimicrobial and UV agents impregnated into the material to inhibit bacteria growth and material degradation.

Figure 1B:
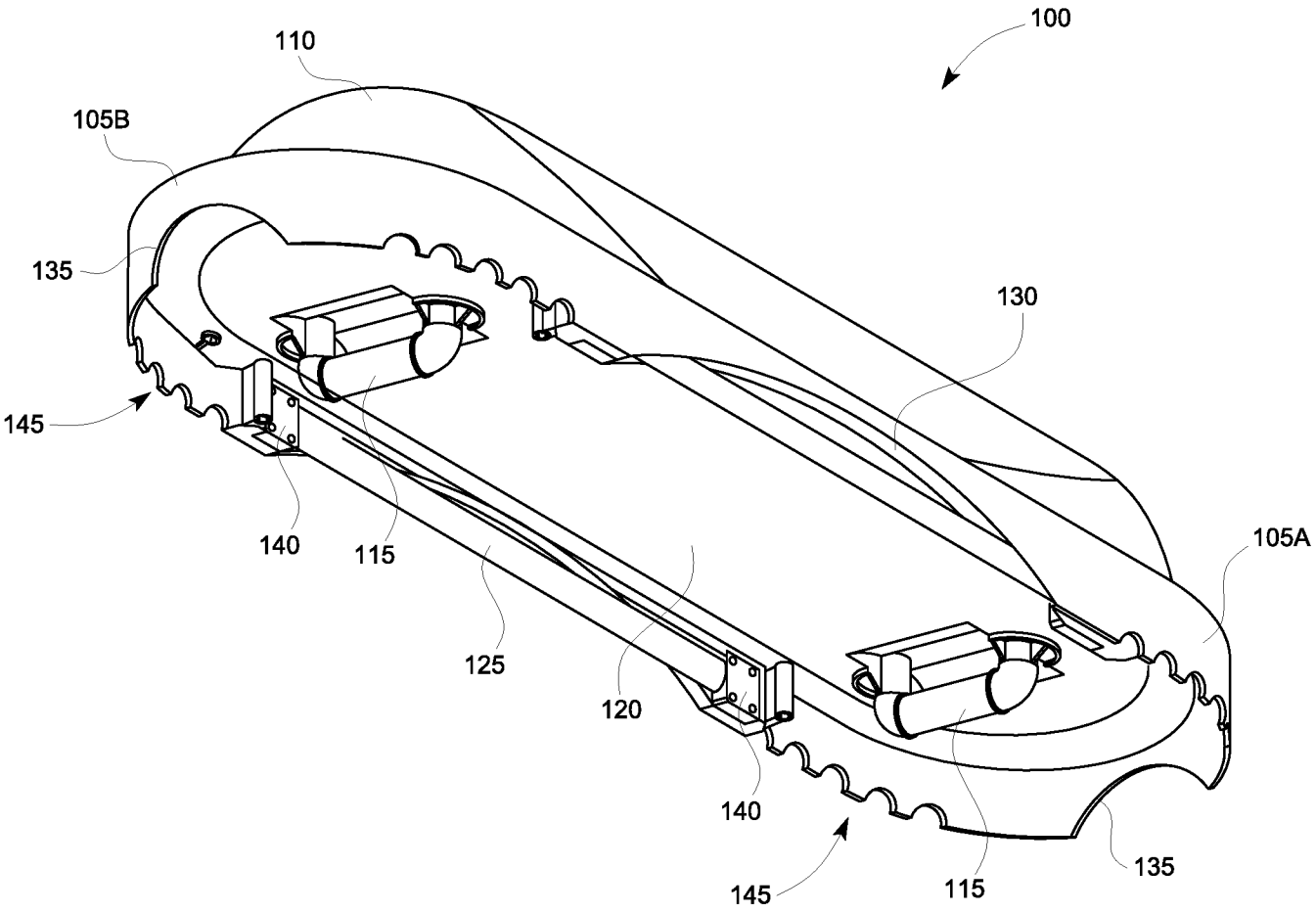

Referring to FIGS. 1A and 1B, a balance exercise device 100 is illustrated according to an embodiment of the present invention. The balance exercise device 100 can be capsule shaped in that it can have a rigid base 105 including substantially straight side walls 105A with end walls 105B that are half circular in shape as shown. The reference to a capsule shape can be reference to common terms used to refer to a three dimensional shape consisting of a cylinder with hemispherical ends. Another name is a spherocylinder in this instance the shape of the balance exercise device is substantially a half cylinder with substantially half hemispherical ends being that the balance exercise device 100 includes a base 105 having the vertical sides 105A that extend along a straight length of the sides meeting the ends 105B of the base which extend vertically around a half circle axis of revolution. The two opposing curved half-circle end walls 105B extend from the opposite substantially straight side walls and create the capsule shaped outer periphery of the substantially rigid base 105.

The balance exercise device includes a flexible bladder 110. The flexible bladder 110 is made of a resilient polymer fastened to the outer periphery of the substantially rigid base 105. The flexible bladder 110 creates an unstable balance exercise surface when filled with air, gas or gel for use during a balance exercise. The balance exercise device 100 can be used in an upright position where the bottom surface of the base 105 sits flat against the ground surface. The balance exercise device 100 can also be used in an upside-down position where the flexible bladder 110 is placed against the ground. And, the balance exercise device 100 can be held using various handles 115 and other features so as to use the instability of bladder 110 or the weight of the balance exercise device 100 during the plurality of exercises discussed herein.

The side walls 105A and end walls 105B of the base 105 can define a base interior 120. The base interior 120 being defined as a recessed area within the side walls 105A and end walls 105B of the base 105. The base interior 120 being defined within interior surfaces of the side walls 105A and end walls 105B of the base 105 within which the base interior 120 include one or more exercise features such as the handles 115 and longitudinal rods 125. For example, as shown in FIG. 1B, the one or more exercise features include the two handles 115 affixed to the interior surface 120 of the base 105. The two handles 115 are disposed relative to one another so as to balance the exercise device 100 relative to the handles 115. The two handles 115 are similarly disposed relative to the ends 105B and sides 105A of the base 105. When used in "upside-down" exercises where the flexible bladder 110 rests on the ground surface the handles 115 can be used to balance a user while performing pushups or other relatively unstable exercises with the inflated flexible bladder 110 may rock or move in a relatively unstable manner against the ground surface.

Conversely, the handles 115 are recessed within the base interior 120 and when the hard bottom surface of the base 105 is placed firmly on the ground the user is able to step or stand on the flexible bladder 110 during various exercises with otherwise stable engagement of the bottom of the base 105 with a relatively flat ground surface.

The handles 115 also enable a user to lift the balance exercise device 100 and use the weight of the balance exercise device 100 during a lifting exercise. For example, the user can lift the weight of the balance exercise device 100 overhead. And, the balance exercise device 100 can be used to move from one entirely independent exercise to a different entirely independent exercise while firmly holding the handles 115 disposed in the base interior 120. For example, the user can perform a pushup exercise then transition to a lifting exercise.

The base 105 includes opposing sidewall cutouts 130 defined in the side walls 105A. The base 105 can also include end wall cutouts 135. The sidewall cutouts 130 and end wall cutouts 135 can provide a handle for lifting the balance exercise device 100 by its sides and ends respectively. The sidewall and end wall cutouts can also provide access to base interior features such as the longitudinal rods 125 disposed within the interior 120 and adjacent to the sidewall cutouts 130.

The rods 125 within an interior length of the base side walls 105A and adjacent to the cutouts 130 defined in the side walls 105A. Opposing ends of the rods 125 can be anchored 140 to the interior 120 of the base 105 of the balance exercise device 100. The anchors 140 can be end pieces that include an anchoring feature corresponding to the ends of the rods 125 along with fasteners for affixing the rods 125 to the interior 120 of the base 105 at a predetermined internal sidewall 105A location. The sidewall 105A location can correspond with the cutouts 130 to the side walls 105A of the base 105 so as to allow access to the rods 125. The access to the rods 125 provided by the sidewall cutouts 130 can be provided when the balance exercise device 100 is in an upright position and disposed on a substantially flat ground surface. The rods 125 may also be held with unobstructed access thereby due to the sidewall cutouts 130 disposed adjacent thereto when in the upside-down exercises and lifting exercises. As such, the rods 125 can be held by opposing hands of the user without obstruction by the side walls 105A relative to the hands of the user.

The balance exercise device 100 can further include a plurality of resistant band attachment features. The resistant band attachment features can include a plurality of band cutouts 145 in the side walls 105A or end walls 105B of the base 105 as shown in FIGS. 1A and 1B. The resistant band cutout features 145 can allow for different positions and angles from which the resistant bands can be held. The various resistant band cutout features 145 can be disposed proximate to and around both end walls 104B of the base 105 as shown and can include additional resistant band adjustment cutouts 145 along the side walls 105B of the base 105 as shown. In the embodiment illustrated in FIGS. 1A and 1B, the resistant band features 145 of the base 105 extend in a series of six optional and available resistant band cutouts 145 disposed between the sidewall 105A cutouts 145 and the end wall 105B cutouts 145 of the base 105. The multiple cutout features 145 on opposing side walls 105A and end walls 105B can be used for repositioning the opposing location of the resistant band wrapped underneath and around the base 105 of the balance exercise device 100 using the band locating features 145. Thus, one or multiple resistant bands can be use and can extend from different locations of the bottom surface of the base 105 of the balance exercise device 100.

Figure 2B:
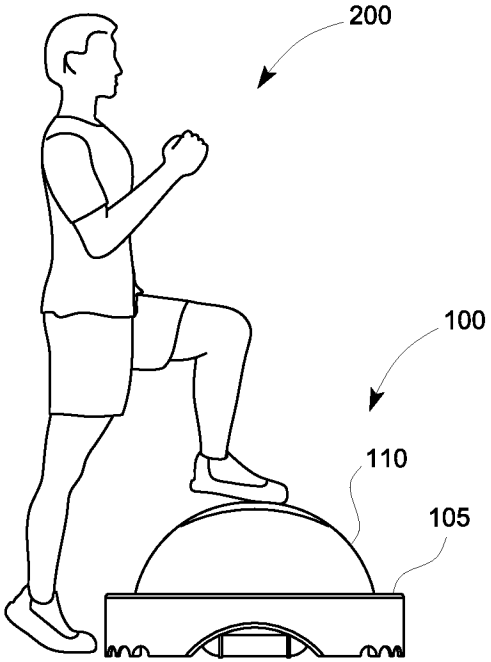
FIGS. 2A, 2B, 2C, 2D, 2E, and 2F illustrate a plurality of exercises using the balance exercise device.
Figure 2A:
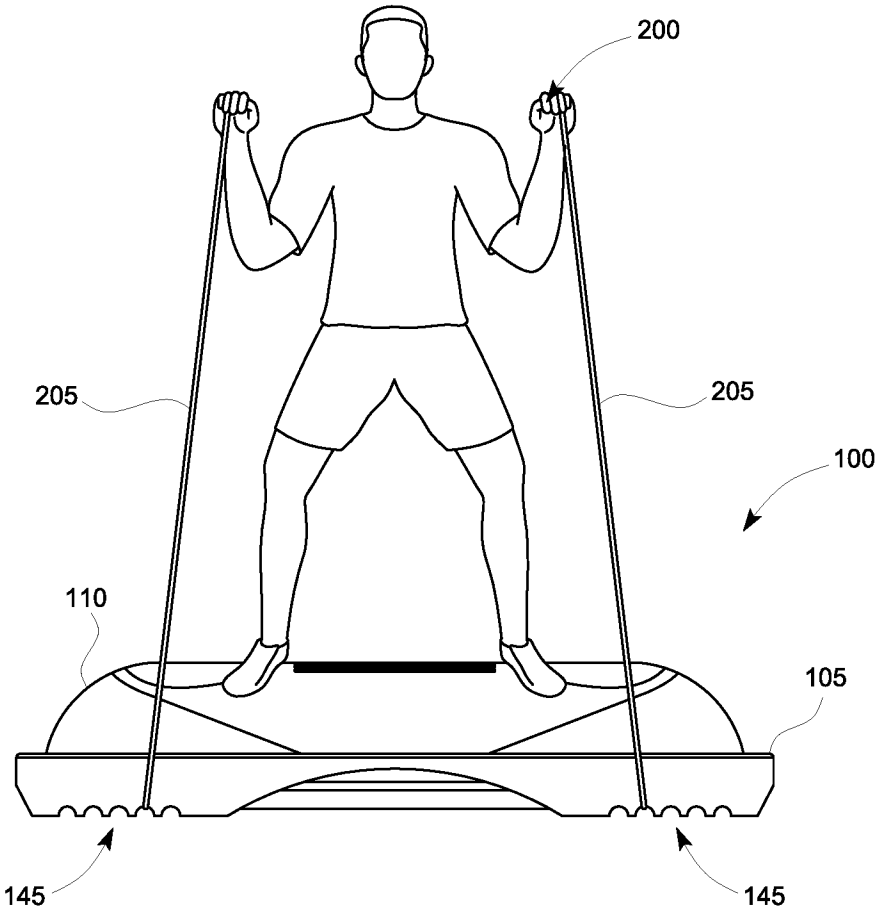

FIGS. 2A-2F illustrate examples of the many different exercises that may be performed using the step exercise device 100. FIG. 2A illustrates a user 200 standing on the flexible bladder 110 of the step exercise device 100. The user 200 may perform various standing exercises and is shown using two resistant bands 205 coupled to the cutout band features 145 of the base 105 of the step exercise device. The user 200 can perform various resistance exercises while holding the resistant bands 205. For example, the user 200 can perform one or more arm exercises while standing on the flexible bladder 110 of the step exercise device 100. The user 200 can also perform various leg exercises by crouching, stepping, and adjusting their stance position while introducing additional resistance from holding the resistance bands 205. The flexible bladder 110 introduces a level of instability to the user 200 while standing thereon introducing additional core exercise as well as coordination and balance training in addition to the resistance and various physical activities of traditional step exercises.

FIG. 2B illustrates a step exercise which can be performed with or without resistance bands 205. In this instance the user 200 performs a step exercise where the user transitions from leg-to-leg stepping onto the flexible bladder 110 of the step exercise device 100. The instability of the step exercise introduced by the flexible inflated bladder 110 again introduces a level of instability improving core strength, coordination, and balance of the activity performed as compared to traditional step exercises using rigid step products.

Figure 2D:
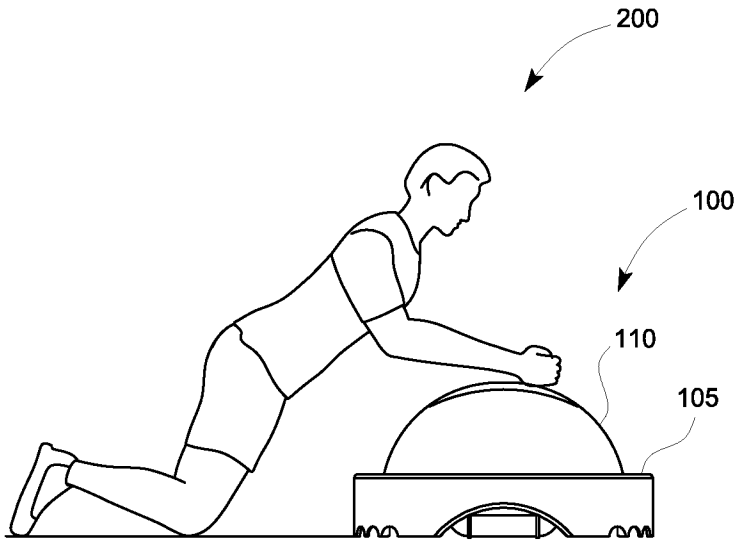
Figure 2C:
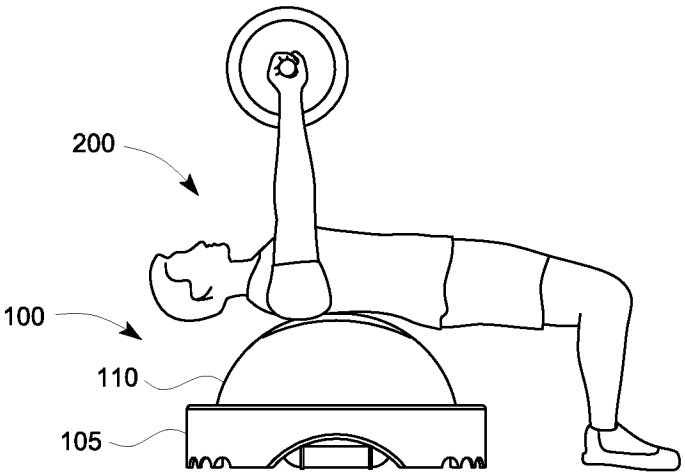

FIG. 2C illustrates the user 200 performing a free weight exercise while using the balance exercise device 100 for back support. Similarly, the user 200 can use the resistance bands such a position as previously illustrated. In this instance the feet of the user 200 are placed on ground surface and only the back of the user 200 is supported by the flexible bladder 110 of the balance exercise device 100. This free weight exercise can be performed as shown with the length of the step exercise device 100 being substantially perpendicular to the torso of the user, or in another embodiment the torso of the user 200 can be disposed parallel to the length of the balance exercise device 100 to increase the lateral instability thereto due to the reduced width of the balance exercise device 100 compared to the length of the balance exercise device 100 of its capsule shape. Thus, use of the capsule shape further introduces additional exercise options depending on the direction to which it is oriented during an exercise. As previously discussed the user 200 can employ one or more flexible cord exercises that can be used to provide resistance to the user's arms, legs, or pelvis during extensions.

FIG. 2D illustrates a kneeling or prone position where the user 200 faces the balance exercise device 100 disposed in an upright position. The user is able to perform pushups or other exercises by pressing against the flexible bladder 110 supported by the base 105 disposed on ground surface. The user can perform two arm or one arm pushup with increased instability from the flexible bladder 110 introducing addition benefits of core strength, balance, and coordination.

Figure 2F:
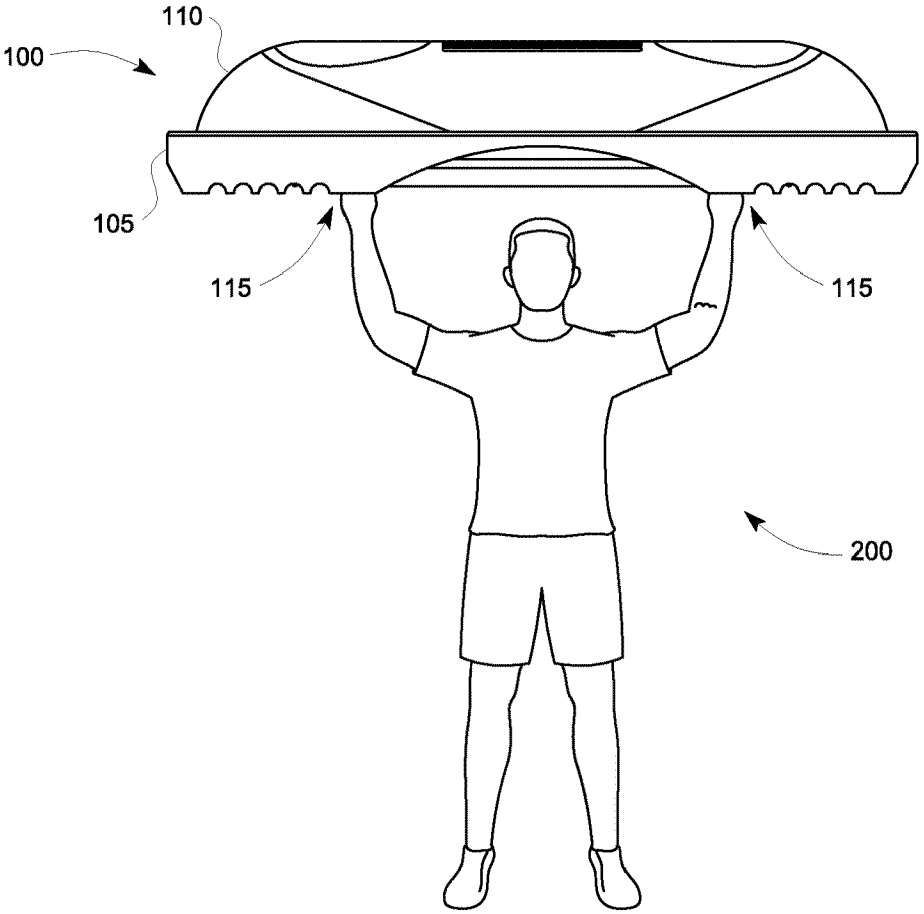
Figure 2E:
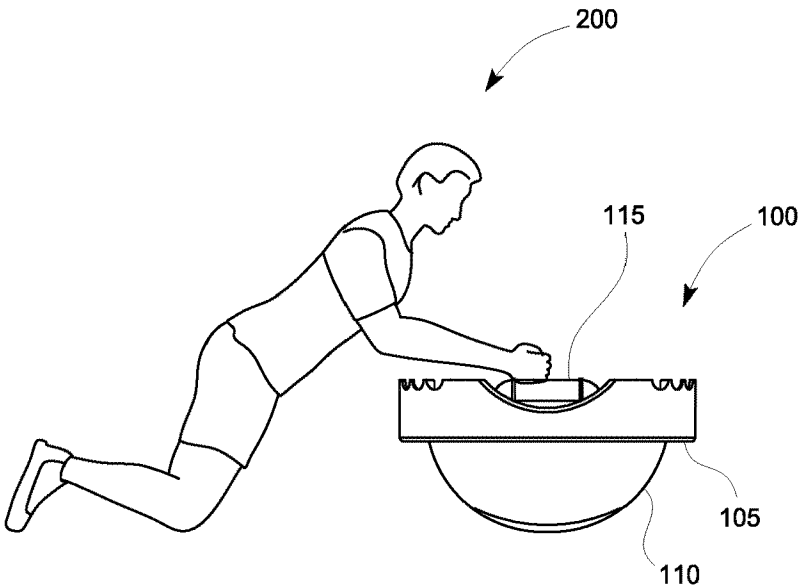

FIG. 2E illustrates the use of the handles 115 by the user of the balance exercise device 100 disposed in an upside-down position. In this position, the user 200 can perform pushups or other exercises while grasping the handles 115 disposed in the interior space of the base 115 of the balance exercise device 100. Where the flexible bladder 110 is used in this position to engage the ground surface additional instability is introduced into the exercise as the instability of the balance exercise device 100 is increased as opposed to the upright position where the substantially rigid base 105 engages the ground surface.

FIG. 2F illustrates the use of the weight of the balance exercise device 100 during exercise. In this illustration the user 200 of the balance exercise device 100 grips the handles 115 and lifts the balance exercise device 100 overhead. Thus, this user 200 can use the weight of the balance exercise device 100 during strength and aerobic training. Moreover, with reference to both FIGS. 2E and 2F, the user 200 of the balance exercise device 100 can transition between the multiple different exercises according to a routine. For example, the user can perform the pushup exercise of FIG. 2E then transition into the lifting exercise of FIG. 3F. As such, the versatility of plurality of available exercises provided by the balance exercise device 100 provides for many multi-purpose activities and enhanced introduction of available workout opportunities. As mentioned, the step exercise device can be associated with a first exercise position of a routine where a first exercise is performed with the base against the ground, a second exercise position of the routine where a second exercise is performed with the bladder against the ground, and a third exercise position of the routine where a third exercise is performed lifting the balance step exercise device overhead.

Figure 3A:
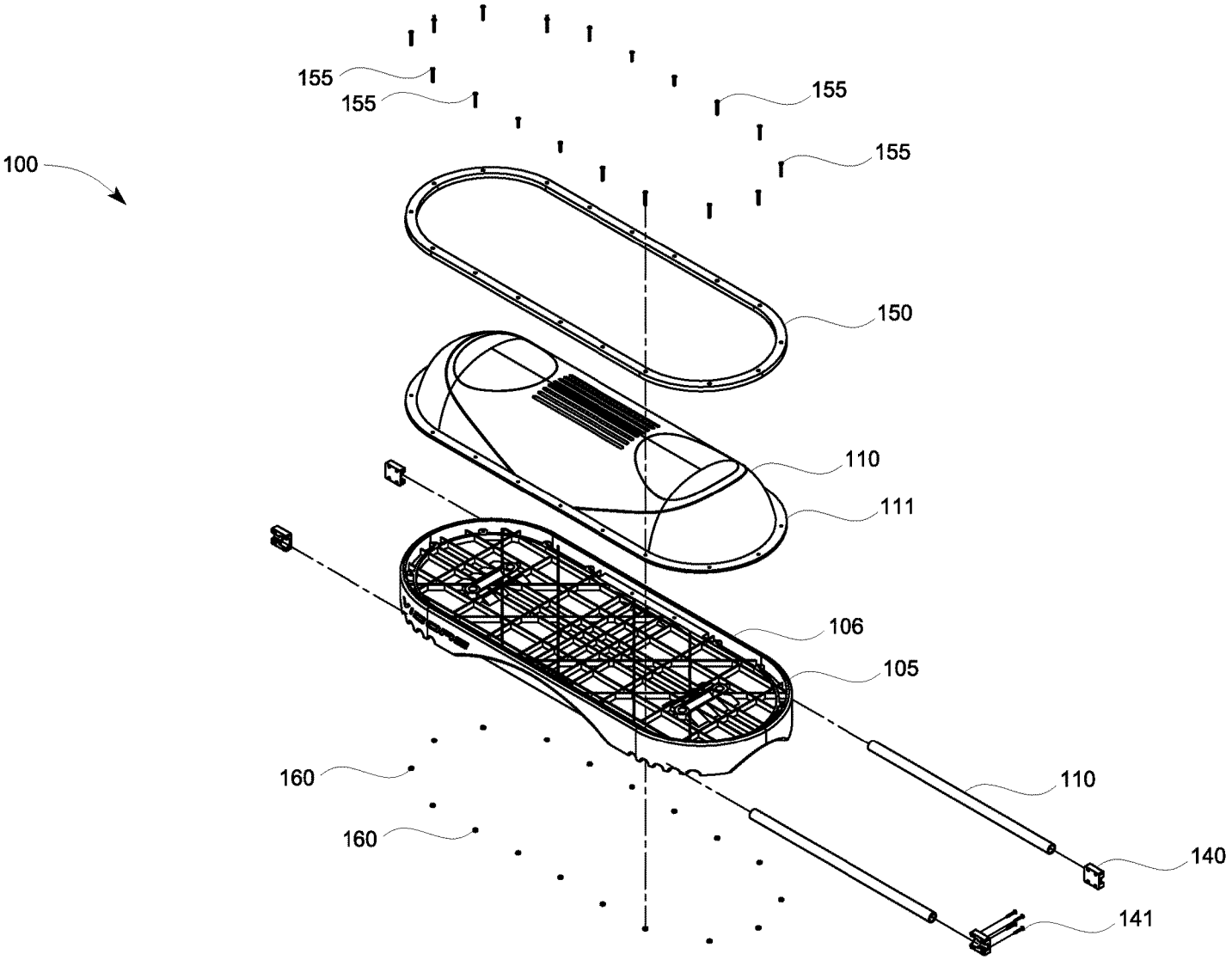
FIGS. 3A and 3B illustrate methods for design, manufacture, and assembly of a balance exercise device.
Figure 3B:
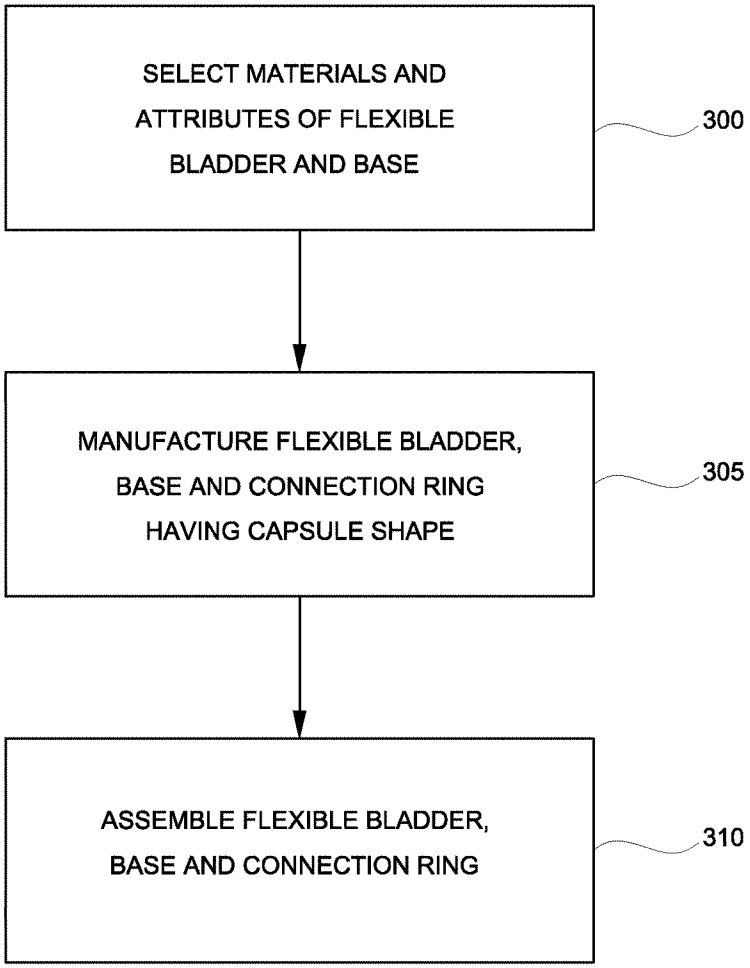

FIGS. 3A and 3B illustrate methods of design, manufacturing and assembling a balance exercise device 100. The balance exercise device 100 includes the base structure 105. The base structure 105 can be manufactured from a relatively rigid and inflexible material such as a relatively inflexible plastic or PVC. The balance exercise device 100 can further include a relatively flexible inflatable bladder 110. The flexible bladder 110 can be made of a relatively flexible and resilient material such as a rubber, silicone, or other flexible polymer.

The base 105 of the balance exercise device 100 can include an upper peripheral surface 106 corresponding to an outer peripheral surface 111 of the flexible bladder 110. Mating of the upper peripheral surface 106 of the base 105 with the outer peripheral surface 111 of the flexible bladder 110 creates an airtight seal when held firmly together by a connection ring 150. The connection ring 150 can include a shape conforming to the capsule shape of the outer periphery shape of the balance exercise device 100 and conforming to the upper peripheral surface 106 of the base and the outer peripheral surface 111 of the flexible bladder 110. The connection ring 150 can be made of a substantially rigid material such as a metal or hard plastic ring. The connection ring 150 is disposed over the outer peripheral surface 111 of the flexible bladder 110 to press the outer peripheral surface 111 of the flexible bladder 110 firmly against the upper peripheral surface 106 of the base 105. To do so, multiple fasteners 155 extend through holes in the connection ring 150 and holes in the outer peripheral surface 111 of the flexible bladder 110 and into the upper peripheral surface 106 of the base 105 of the balance exercise device 100. Examples of fasteners 155 includes screws and bolts that extend through the connection ring 150, through the peripheral edge 111 of the flexible bladder 110 and into the side end walls 105A of the base 105 to firmly hold the peripheral surface 111 of the flexible bladder 110 against the upper peripheral surface 106 of the base 105 and create the airtight seal there between. In the example, illustrated in FIG. 3A the bolts 155 extend through the connection ring 150, flexible bladder 110 and base 105 and are tightened to corresponding nuts 160 to apply a sufficient pressure to the connection ring 150 to ensure that a sufficient seal is maintained by the tensile strength of the nuts 160 and bolts 155.

As shown in FIG. 3A, two rods 110 are assembled with the base 105 using corresponding anchors 140. The rod anchors 140 are disposed at the ends of the rods 110 and include anchor fasteners 141, such as screws or bolts to attach the rods 110 via the anchors 140 to an interior sidewall surface of the base 105.

A method for manufacturing and assembling a balance exercise device can includes selecting an attribute for a flexible bladder (300). The material of the flexible bladder being selected to provide a level of instability when filled by pressurized air, gas, or a gel. The attribute selected can include a thickness of the flexible bladder. The attribute of the flexible bladder can include a shape of the flexible bladder. The shape of the flexible bladder can be capsule shape. And the capsule shape of the flexible bladder can include relatively straight sides with half circle shaped end portions. Flexible bladder shape can be a half cylinder with half hemispherical ends shape or half spherocylinder shape.

The method can further include selection of base attributes (300). The base can have an upper peripheral surface shape that corresponds to the outer peripheral shape of the flexible bladder for creating an airtight seal there between when held firmly together. The base can include substantially vertical and straight side walls as well as half circular vertical end walls. The side walls and end walls of the base creating an interior space when placed on a flat ground surface. Within the interior of the base the side and end walls are connected by an interior surface to which various features are connected or formed. The features include one or more handles. The one or more handles can include two handles attached or formed on opposing sides of the base interior. The handles can be disposed on a centerline of the length of the interior surface so as to hold the handle in a balanced manner with respect to the base. The method can include providing, forming or attaching additional features such as longitudinal rods to the interior of the base structure.

The method can include providing, manufacturing or forming the flexible bladder, base and connection ring (305). The shape of the connection ring corresponding to the outer peripheral shape of the flexible bladder and upper peripheral surface of the base. The method can further include assembling the flexible bladder with the base and affixing the periphery of the flexible bladder to the base using the connection ring and a plurality of fasteners (310).

The substantially straight sides of the substantially rigid base can extend between 20 and 40 inches in length and the opposing curved ends defining a half-circle having a radius between 10 and 20 inches. The width of the base can be between about 15 and 18 inches and the end to end length of the base can be between about 43 and 48 inches. Other features and relative dimensions are shown and described in the figures and described herein other illustrative dimensions are disclosed in 62/298,385 incorporated herein by reference which can be varied by 5%, 10%, 15%, 20% or a fraction thereof.

The capsule shape has been found by the inventor as having advantages in the design, manufacture, and use of the balance exercise device. For example, the capsule shape has particularly advantages over a square, rectangular and circular shape. For example, the tablet shape provides the improved width of a rectangular shape over a circular shape while avoiding the non-uniform pressure point distribution of force relative from the corners of a rectangle and the sides of the rectangle. Rather, near the ends of the capsule are the half circle shape which finds a similarly more uniform distribution of force and balance properties as compared to a rectangle. In addition, the capsule shape has particular advantages over other shapes because it can provide the length to be used perpendicular to the user's torso or parallel thereto thereby introducing more plurality of available exercises. By simply changing the direction of use of the balance exercise device relative to the user's body or stance can dramatically change the difficulty and instability introduced thereby during various additional exercise options. Moreover the introduction of an angle or height to the capsule shape provides directional differences in the manner in which the balance exercise device can be used.

Figure 4:
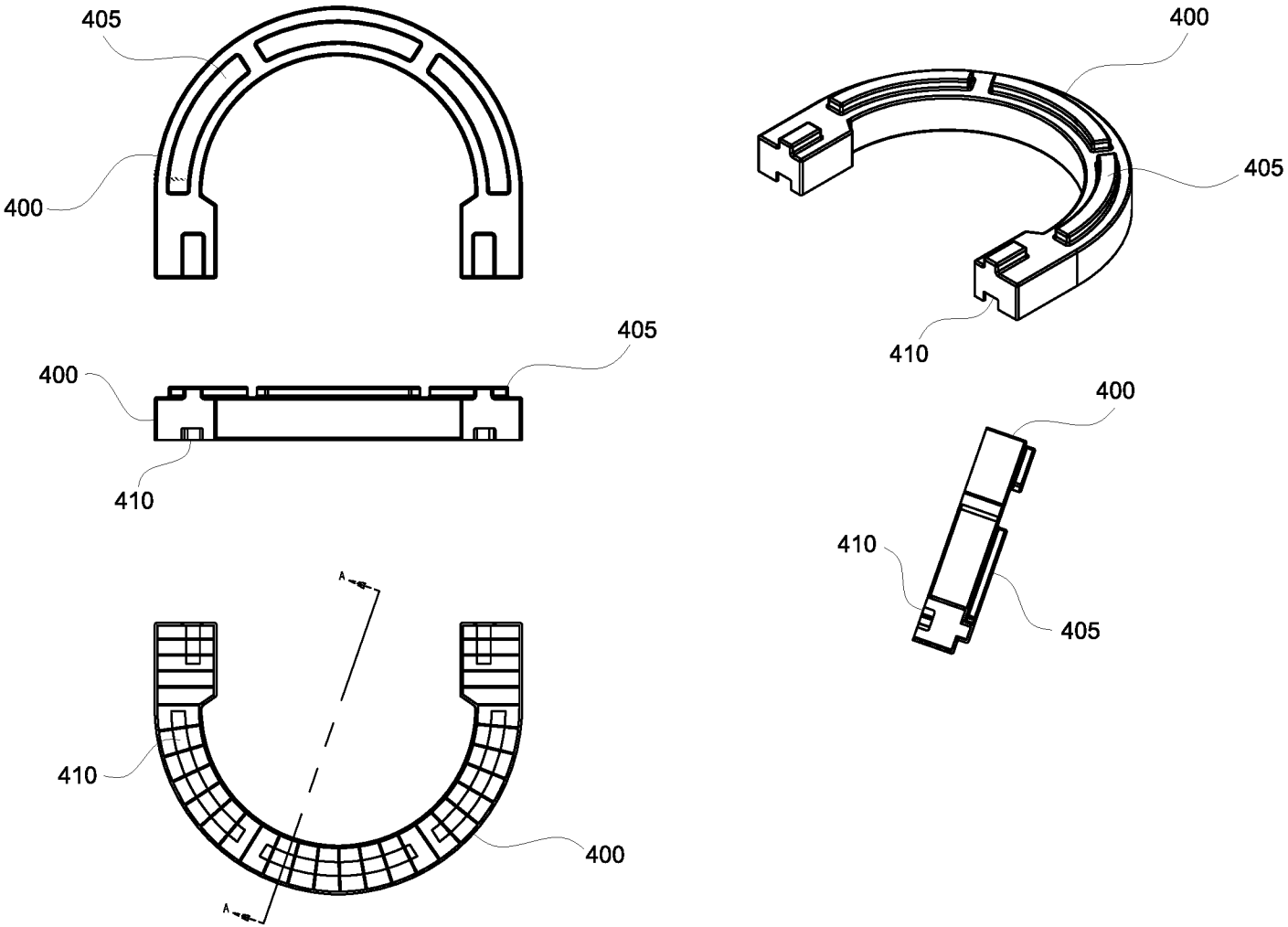
FIG. 4 illustrates a height adjustment attachment.

FIG. 4 illustrates a height adjustment attachment 400. The height adjustment attachment 400 can be placed under a base or to the bottom surface of the base so as to increase a height of a balance exercise device above ground. The height adjustment attachment 400 can include key features 405 that correspond to slot features of the base so as to locate and retain the location of the height adjustment attachment 400 relative to the base. The shape of the height adjustment attachment 400 can conform to the shape of the end walls of the base and a portion of the side walls of the base as illustrated. The height adjustment attachment 400 can further include additional slot features 410 disposed on a surface opposite to the key features 405. The slot features 410 can correspond with the key features 405 of an additional similarly configured height adjustment attachment 400 so as selectively stack multiple height adjustment attachments 400 to obtain a desired height of a balance exercise device.

Figure 5B:
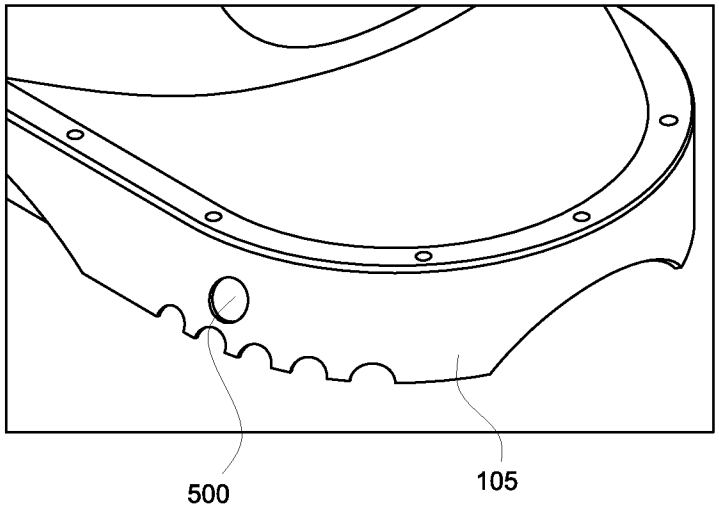
FIGS. 5A and 5B illustrate hole features for the use of additional exercise accessories.
Figure 5A:
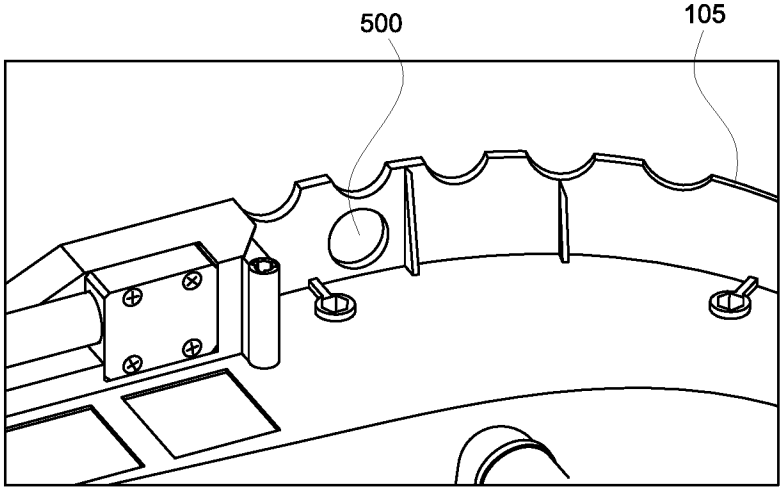

FIGS. 5A and 5B illustrate holes 500 disposed in the sidewall 105 of the base of the balance exercise device 100. These holes 500 are features for using addition exercise accessories. For example, ends of the additional exercise accessories can extend through the holes 500 and provide handles, and support structures for performing additional exercises. The accessories can pivot around the holes 500 or be similarly affixed or biased to the interior surface.

Figure 6A:
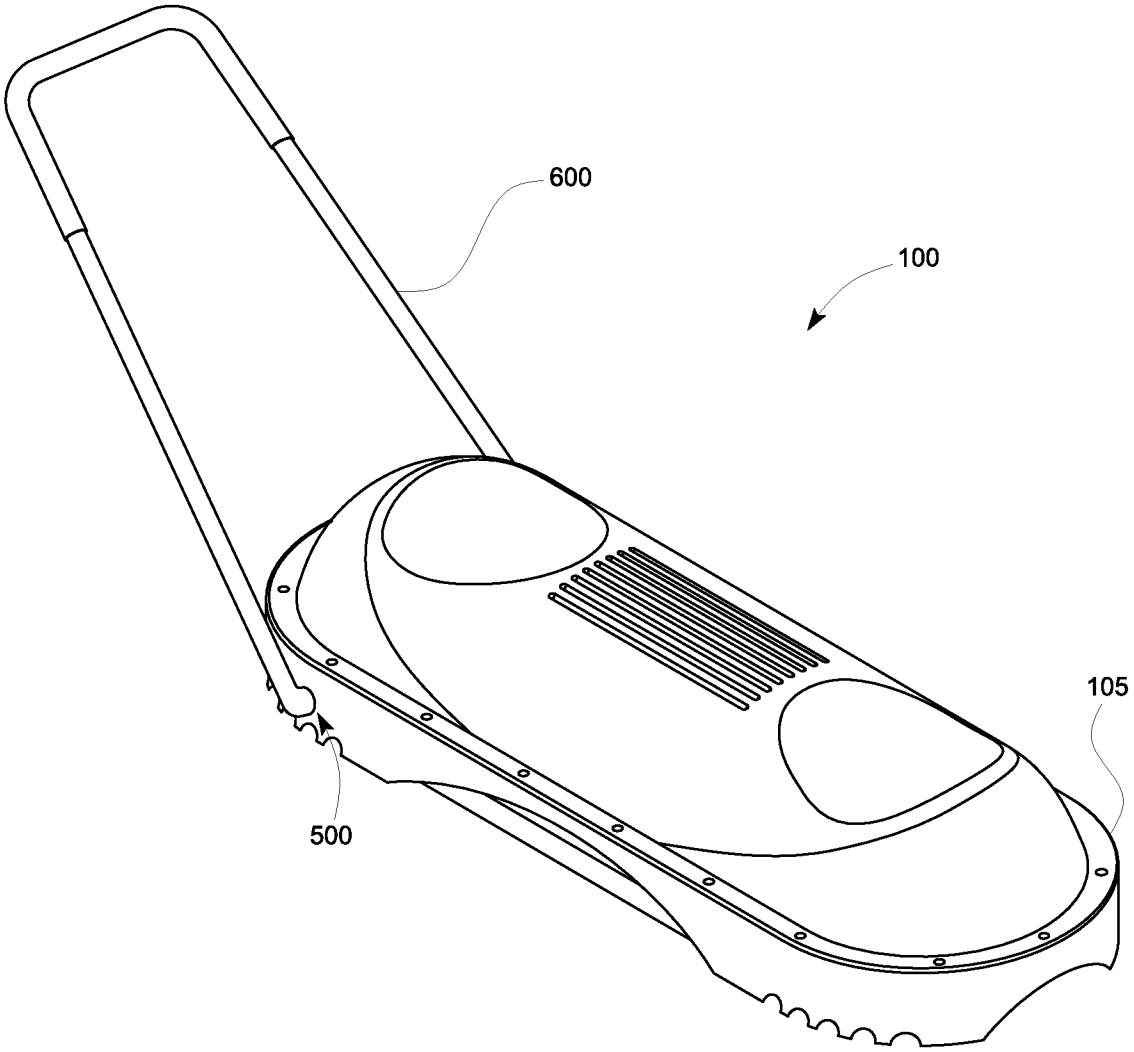
FIGS. 6A and 6B illustrate examples of additional exercise accessories.

Referring to FIG. 6A, an additional accessory 600 can include a bar structure extending from the holes 500 disposed in the base 105 and from a first side of the balance exercise device 100 allowing for a user to push and pull the balance exercise device 100 over a ground surface.

Figure 6B:
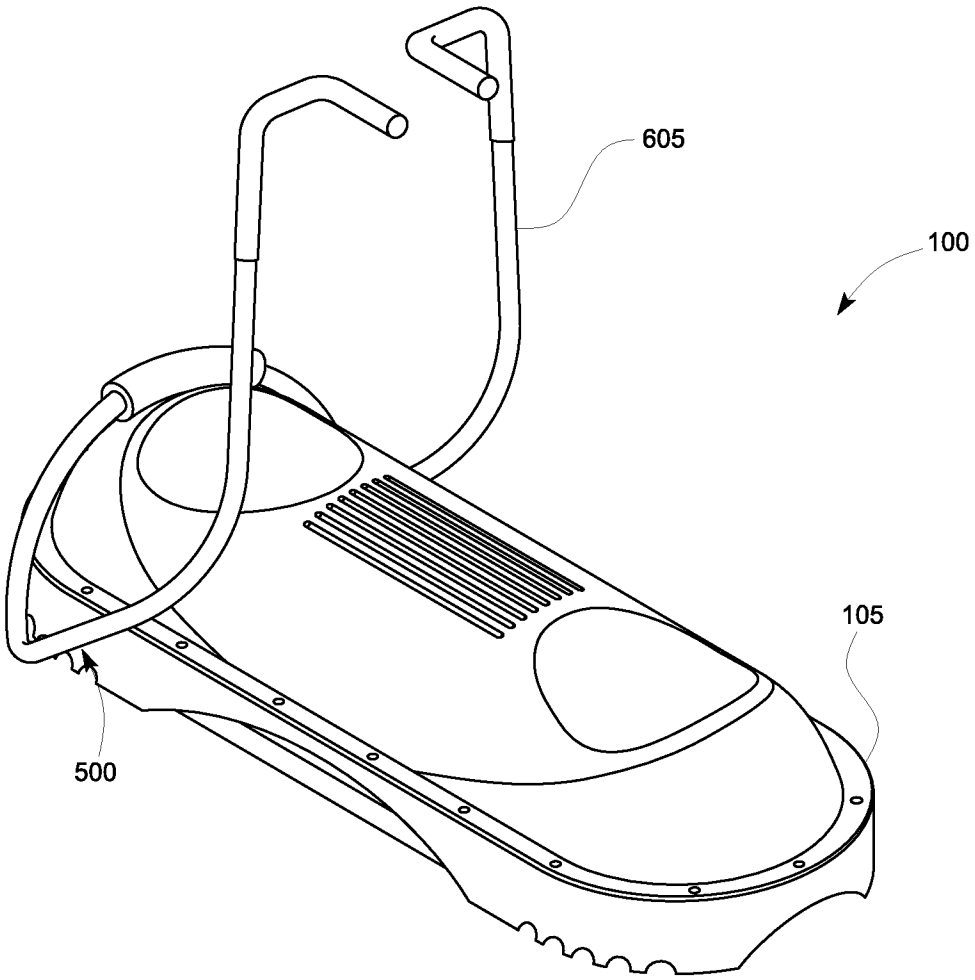

Referring to FIG. 6B, a rotatable bar accessory 605 is illustrated providing a neck and/or arm support for a prone position exercise. The rotatable bar accessory 605 extends form the holds disposed in the base 105 allows for additional support during an abdominal crunch exercise. The bar structures can include handles that extend up and over or around the balance exercise device 100.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It is understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the phrases "at least one" and "one or more" to introduce claim recitations. However, the use of such phrases should not be construed to imply that the of a claim recitation by the indefinite articles "a" or "an" limits any particular claim containing such introduced claim recitation to embodiments containing only one such recitation, even when the same claim includes the phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, quadrants, thirds, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 routes refers to groups having 1, 2, or 3 routes. Similarly, a group having 1-5 zones refers to groups having 1, 2, 3, 4, or 5 zones and more or less, and so forth.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims. All references recited herein are incorporated herein by specific reference in their entirety.

What is claimed is:

1. A balance exercise device, comprising:

a substantially rigid base including:

a top surface;

a bottom surface;

a first side wall extending along a length of the substantially rigid base;

a second side wall extending along the length and being disposed opposite to the first side wall;

opposing cutouts respectively defined in the first and second side walls;

opposing rods respectively disposed within an interior of the substantially rigid base and extending along an interior length of the first and second side walls and adjacent to the opposing cutouts respectively defined in the first and second side walls; and two opposing curved half-circle end walls respectively extending from opposing ends of the first and second side walls and creating a capsule shaped outer periphery of the substantially rigid base; and a flexible bladder fastened to a periphery of the top surface of the substantially rigid base, the flexible bladder creating an unstable balance exercise surface when filled with air for use during a balance exercise.

2. The balance exercise device according to claim 1, wherein the first side wall, the second side wall, and the two opposing curved half-circle end walls of the base define a base interior, the base interior including one or more exercise features.

3. The balance exercise device according to claim 2, wherein the one or more exercise features include two handles affixed to an interior surface of the substantially rigid base, the two handles being centrally disposed proximate to the two opposing curved half-circle end walls of the substantially rigid base, respectively.

4. The balance exercise device according to claim 3, wherein the two handles enable a user to perform pushup exercises with the flexible bladder placed against a ground surface.

5. The balance exercise device according to claim 3, wherein the two handles are disposed within the base interior when the bottom surface of the substantially rigid base is placed on a ground surface thereby enabling a user to step or stand on the flexible bladder during the balance exercise.

6. The balance exercise device according to claim 3, wherein the two handles enable a user to lift the balance exercise device using a weight of the balance exercise device during a lifting exercise.

7. The balance exercise device according to claim 1, further comprising a plurality of resistant band attachment features disposed in the first side wall, the second side wall, or the two opposing curved half-circle end walls of the substantially rigid base.

8. The balance exercise device according to claim 7, wherein the plurality of resistant band attachment features include a plurality of cutout features in the bottom surface of the substantially rigid base.

9. The balance exercise device according to claim 8, wherein the plurality of resistant band attachment features include multiple cutout features on the first side wall, the second side wall, and the two opposing curved half-circle end walls for repositioning a location of a resistant band extending around a bottom of the substantially rigid base and from different locations of the bottom surface of the substantially rigid base.

10. The balance exercise device according to claim 1, further comprising a resistance band coupled to two of a plurality of selectable cutouts in the bottom surface of the substantially rigid base.

11. The balance exercise device according to claim 1, the balance exercise device being associated with a first exercise position wherein a first exercise is performed with the substantially rigid base against a ground surface, a second exercise position wherein a second exercise is performed with the flexible bladder against the ground surface, and a third exercise position wherein a third exercise is configured to be performed lifting the balance exercise device overhead.

12. The balance exercise device according to claim 1, the flexible bladder including a flat peripheral seal for mating with the periphery of the top surface of the substantially rigid base so as to create an air-tight seal there between.

13. The balance exercise device according to claim 1, further comprising:

a first hole disposed in the first side wall;

a second hole disposed in the second side wall; and an exercise accessory attachable to the substantially rigid base of the balance exercise device using the first and second holes.

14. The balance exercise device according to claim 1, further comprising a height adjustment attachment for attachment to the bottom surface of the substantially rigid base so as to increase a height of the balance exercise device above a ground surface.

15. A balance exercise device, comprising:

a substantially rigid base including:

a top surface;

a bottom surface;

a first side wall extending along a length of the substantially rigid base;

a second side wall extending along the length and being disposed opposite to the first side wall two opposing curved half-circle end walls respectively extending from opposing ends of the first and second side walls and creating a capsule shaped outer periphery of the substantially rigid base;

a flexible bladder fastened to a periphery of the top surface of the substantially rigid base, the flexible bladder creating an unstable balance exercise surface when filled with air for use during a balance exercise; and a capsule shaped compression ring made of a substantially rigid material and shaped so as to extend over and around a periphery of the flexible bladder to firmly hold the periphery of the flexible bladder against the periphery of the top surface of the substantially rigid base.

16. The balance exercise device according to claim 15, further comprising a plurality of fasteners extending through the capsule shaped compression ring and configured to compress the periphery of the flexible bladder against the periphery of the top surface of the substantially rigid base to create an air-tight seal there between.

17. The balance exercise device according to claim 16, wherein the capsule shaped compression ring creates a substantially flat horizontal lip between a vertical extension of the first and second side walls of the substantially rigid base and a semi-vertical extension of the flexible bladder when the flexible bladder is inflated.

* * * * *